US005765919A

United States Patent [19]

Karlsson et al.

[11] Patent Number: 5,765,919

[45] Date of Patent: Jun. 16, 1998

[54] ADJUSTABLE ARM-REST

[75] Inventors: Goran Karlsson, Vasteras; Carl-Erik Carlsson, Horndal; Pervi Carlsson, Vasteras, all of Sweden

[73] Assignee: FeAl AB, Horndal, Sweden

[21] Appl. No.: 737,416

[22] PCT Filed: Apr. 24, 1995

[86] PCT No.: PCT/SE95/00447

§ 371 Date: Dec. 27, 1996

§ 102(e) Date: Dec. 27, 1996

[87] PCT Pub. No.: WO95/28866

PCT Pub. Date: Nov. 2, 1995

[30] Foreign Application Priority Data

Apr. 25, 1994 [SE] Sweden ..... 9401407

[51] Int. Cl.[6] ..... A47C 7/54

[52] U.S. Cl. ..... 297/411.21; 297/411.22; 297/411.38; 297/411.32; 297/411.36; 248/118; 248/285.1; 248/286.1

[58] Field of Search ..... 297/411.32, 411.36, 297/411.38, 411.2, 411.21, 344.18, 344.14, 338, 423.36, 423.38; 248/118, 285.1, 286.1

[56] References Cited

U.S. PATENT DOCUMENTS

| | | | |
|---|---|---|---|
| 2,560,791 | 7/1951 | Fincher et al. | 297/411.36 |
| 3,625,563 | 12/1971 | Dickinson et al. | 297/423.36 |
| 4,707,032 | 11/1987 | Chang | 297/411.32 |
| 4,907,835 | 3/1990 | Salters | 297/411.21 |

FOREIGN PATENT DOCUMENTS

| | | |
|---|---|---|
| 464164 | 3/1991 | Sweden . |
| 464165 | 3/1991 | Sweden . |
| 465997 | 12/1991 | Sweden . |

*Primary Examiner*—Peter M. Cuomo
*Assistant Examiner*—Anthony D. Barfield
*Attorney, Agent, or Firm*—Hodgson, Russ, Andrews, Woods & Goodyear LLP

[57] ABSTRACT

An arm-rest which can be readily adjusted vertically and laterally and intended, for instance, for a toilet or lavatory seat, and which has few movable parts. A positionally adjustable arm-rest includes an arm-rest part and a frame-part, wherein one end (1) of the arm-support part is inserted together with two surrounding slide blocks (5) into the frame-part (3) enabling the arm-support part to be retained in its raised or lowered position. With the arm-rest in an essentially non-loaded state, the slide blocks (5) fix and hold the arm-rest in a horizontal position. The end of the arm-rest also includes a pressure surface (6) which acts against the inner surface of the frame-part so that the arm-rest will not give way when subjected to load. The user can readily adjust the position of the arm-rest by gripping the part and swinging it slightly upwards while moving the same to the position desired. When the end of the arm-rest has been moved to the height desired, it is released and swung back and now fixed in position to be subjected to load. Lateral adjustment of the arm-rest is achieved by the frame-part (3) resting on a rotatably adjustable floor plate (16), or being rotatably mounted to a wall structure.

20 Claims, 3 Drawing Sheets

17
4
1
5
7
13

17
5
8

4

9

7

11
12

11
3

ADJUSTABLE ARM-REST

TECHNICAL FIELD

The present invention relates to an adjustable arm-rest intended preferably for toilet, or lavatory seats. The arm-rest includes an arm-rest part and a frame-part, wherein the arm-rest part is displaceable in the vertically extending frame-part and is self-locking in its adjusted position, and wherein the frame-part is pivotally adjustable.

DESCRIPTION OF TEE BACKGROUND ART

Adjustable arm-rests are common features of toilet seats for handicap toilets, and facilitate the use of such toilets for handicapped persons, as evident from SE-C-372 223 for instance. In this latter case, a vertically displaceable arm is balanced with the aid of a counterweight, which is connected to an arm-part that projects into a frame-part, by means of a line which runs over guide rollers. The provision of this balancing arrangement requires a relatively large amount of space in the vertical frame-part and also results in slightly unstable journalling of the arm, this instability being noticeable even when the arm is in its arrested vertical position.

Although this instability has been avoided by providing the inner end of the arm with a transversely extending wing or plate (see SE-C-465 997), the arrangement required herewith renders the construction relatively complicated and expensive. Furthermore, no solution has been proposed with regard to the space-requiring problem of the balancing arrangement, and the vertical frame-part consequently has large cross-sectional dimensions. The work involved in fitting the arm-rest is also highly tile-consuming in the case of the known balancing arrangement. Pivotal arm-rests are known from SE-C-464 165. a foot plate provided with two locking shoulders mounted forwardly of the frame-part are intended to coact with a locking pin which is maneuvered with the aid of a pull rod mounted externally on the front side of the frame-part. Although this type of locking arrangement has been found satisfactory, it is encumbered with the drawback of occupying an excessively large amount of space. Another drawback is that the known arrangement is difficult to keep clean and the maneuvering ball is difficult to reach in the case of some users. A journal pin and a journalling sleeve mounted behind the frame-part further amplifies the drawbacks of the known an-rest.

SUMMARY OF THE INVENTION

With the intention of providing an arm rest which can be readily adjusted vertically and laterally and intended, for instance, for a toilet or lavatory seat, and which has but few movable parts, there is provided a positionally adjustable arm-rest which includes an arm-rest part and a frame-part, wherein one end of the arm-support part is inserted together with two surrounding slide blocks into the frame-part such as to enable said arm-support part to be retained in its raised or lowered position. The slide blocks are provided on their bottom edges with a respective spring-accommodating opening, and the arm-rest part is constructed so that the slide blocks are able to secure the arm-rest in a horizontal position and to retain said arm-rest in said position when essentially no load acts on the arm-rest. The end of the arm-rest also includes a pressure surface which acts against the inner surface of the frame-part so that the arm-rest will not give way when subjected to load. A reinforcement plate may be placed between said end of the arm-rest and the inner surface of the frame-part so as to reduce the effect of pressure by distributing the pressure onto the inner surface of the frame-part, without damaging said inner surface. This construction enables the user to readily adjust the position of the arm-rest. All that is required in this regard is for the user to grip the arm-rest part and swing it slightly upwards while moving the same to the position desired. The only resistance that need be overcome is that which corresponds to the holding force of the two slide locks. When the end of the arm-rest has been moved to the height desired, the arm-rest part is released and swung back. The arm-rest part can now be fixed in position and subjected to load, by virtue or the pressure surface on said end of the arm-rest. Lateral adjustment of the arm-rest is achieved by virtue of the frame-part resting on a rotatably adjustable floor plate, or being rotatably mounted on a wall structure.

DESCRIPTION OF AN EMBODIMENT OF THE INVENTION AT PRESENT PREFERRED

Figure 1A:
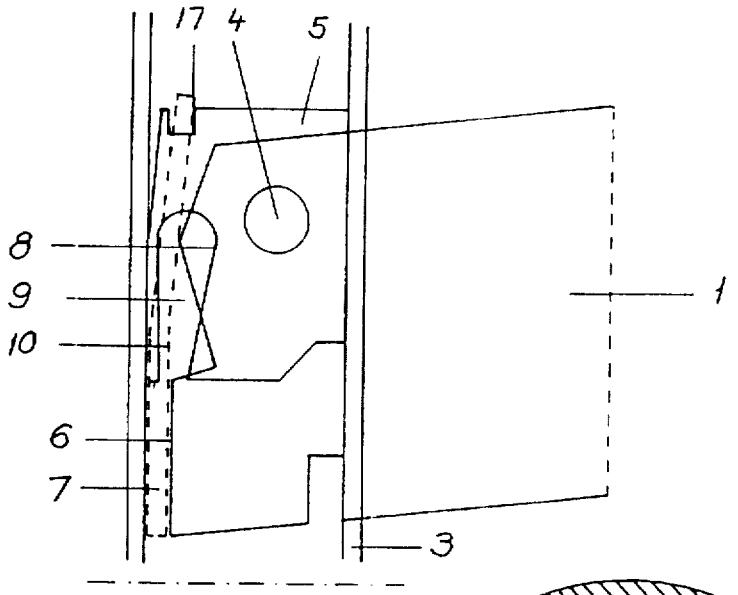
FIGS. 1A–1B illustrates an inventive adjustable arm-rest.
Figure 1B:
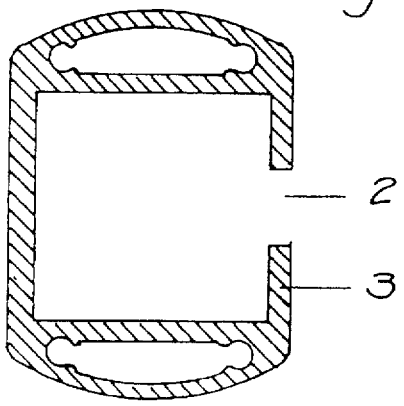
Figure 1B:
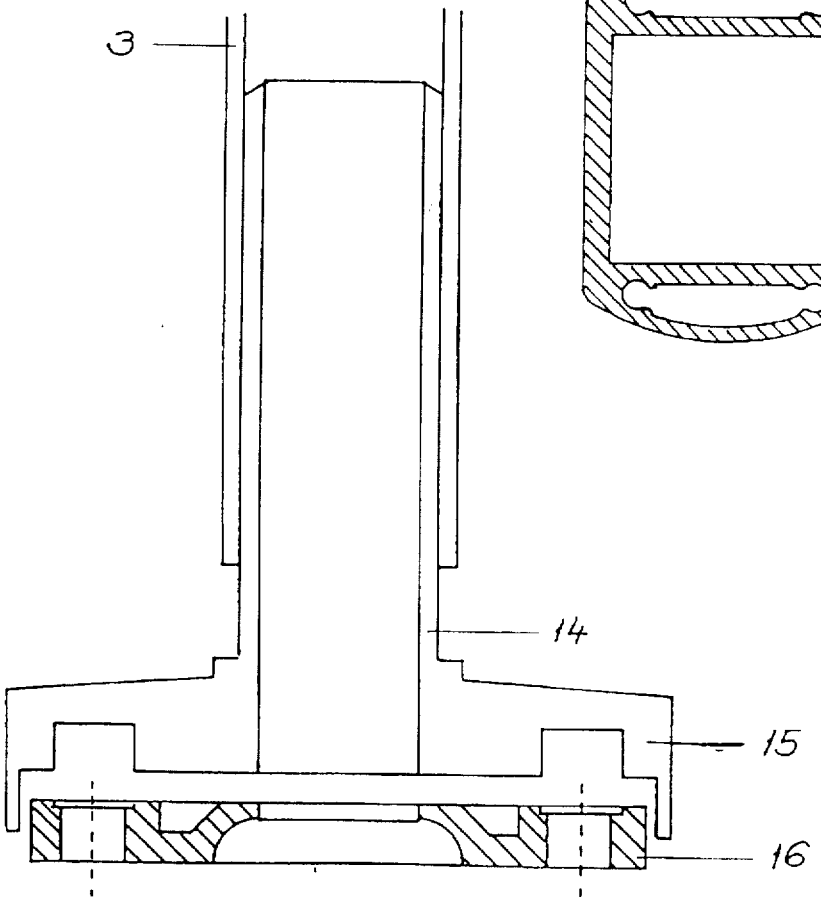
Figures 2A, 2B, 2C, 2D, 2E, 2F, 2G:
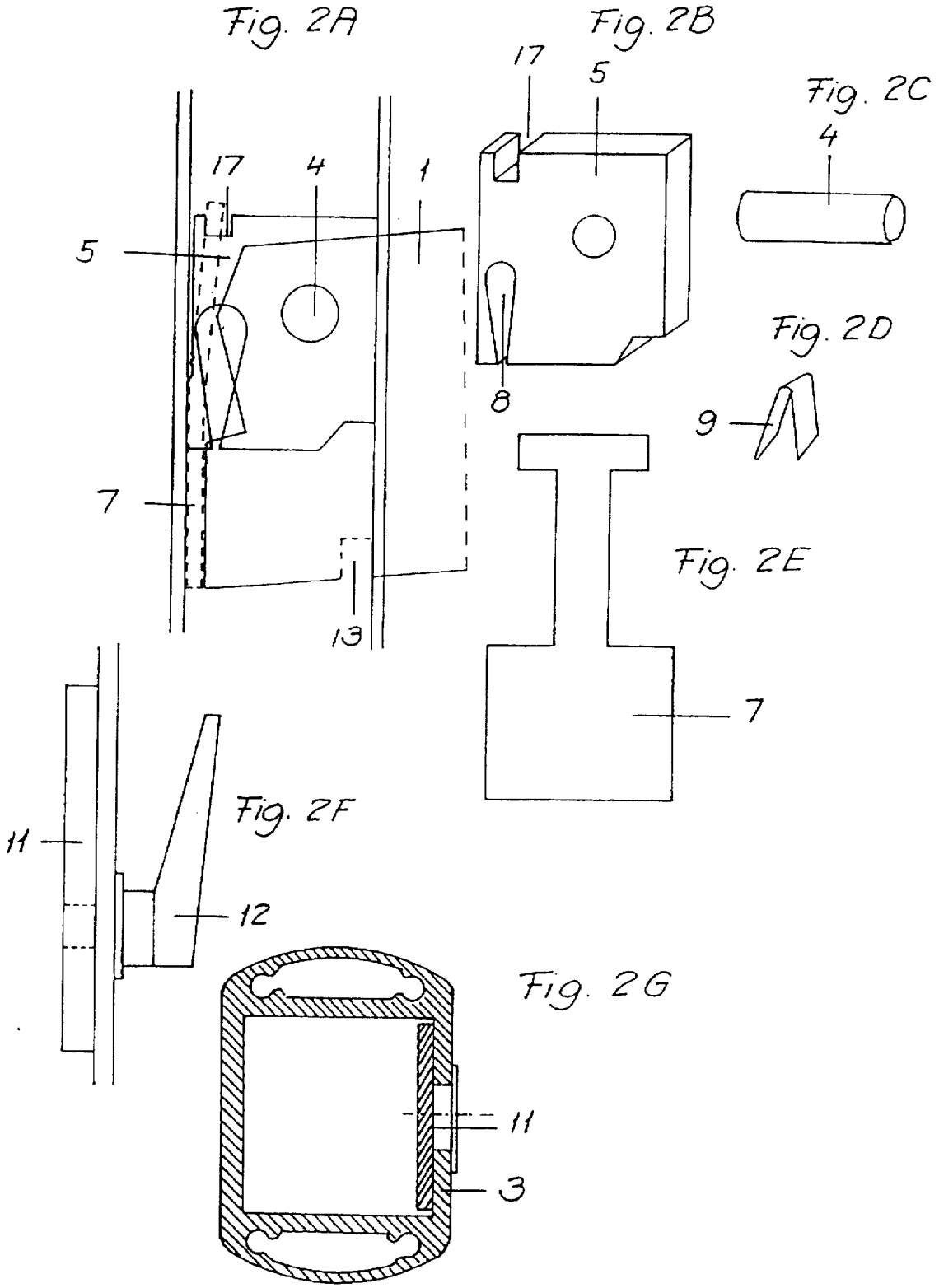
FIGS. 2A–2G illustrates the parts f or vertical adjustment of the arm-rest Shown in FIG. 1 in more detail.
Figure 3A:
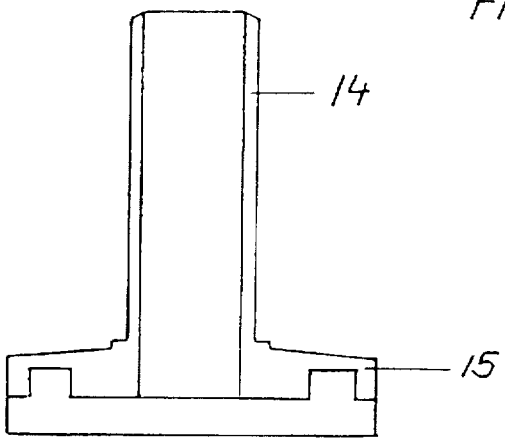
FIGS. 3A–3D shows the parts for lateral adjustment of the arm-rest shown n FIG. 1.
Figure 3B:
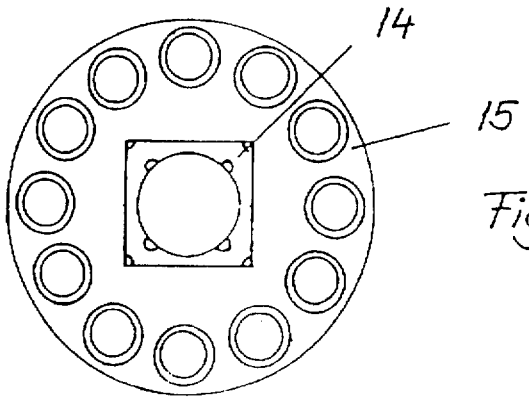
Figure 3C:
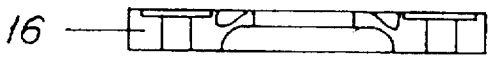
Figure 3D:
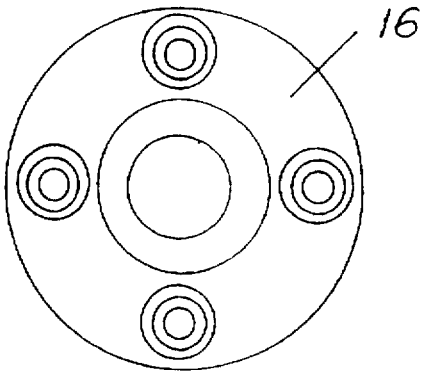

FIG. 1 illustrates the means by which an inventive arm-rest can be adjusted. Shown in the Figure is a part 1, of an elongated body which may be provided with an arm-rest surface. The part 1, which is comprised of one end of the elongated body, is inserted through a slot 2 in a hollow frame part 3 having a square internal shape, and is pivotally joined by means of a pin 4 to slide blocks 5 mounted on respective sides of the frame-part. When load is exerted on the arm-rest with the arm-rest generally horizontal, the rear side 6 of the arm-rest will press against a reinforcing plate 7 which in turn presses against the inner surface of the frame part 3, therewith fixing the arm-rest in its vertical position. In order to prevent the end of the arm-rest being lowered or raised by pivoting the arm-rest upwards from its horizontal position, which would mean that the rear side 6 no longer presses against the reinforcement plate 7 and the inner wall of the frame part, the bottom edges of the slide blocks 5 that face inwardly towards the inner wall of the post have been provided with a respective opening 8 which accommodates a spring 9. With a correctly dimensioned spring 9 mounted in the opening a of respective slide blocks, the outer surface 10 of the bottom edges can be pressed against the inner surface of the frame-part, wherewith the slide blocks will always be secured in the frame part when no load acts on the arm-rest, so as to enable the height of the arm-rest to be adjusted prior to subjecting the arm-rest to load. When adjusting the height of the arm-rest, the arm-rest is lifted or lowered by manually angling or, pivoting the arm-rest upwards slightly to the position required, this manual force required easily overcoming the frictional force of the slide blocks against the inner wall. Should the user raise a handle unintentionally, the position of the arm-rest will remain fixed without the rear side of the arm-rest Dressing against the plate and the inner wall. The upper T-shaped part of the plate is placed in arm upper recess in respective slide blocks. In order to limit the movement of the arm-rest in the frame part, there can be inserted in the groove 2 a stop means which includes a plate 11 and with which a runner having a screw means 12 or the like functions to fix the stop means in position. The bottom edge of the arm-rest may be provided with a recess 13 or some like aperture for accommodating the edge of the stop means.

The frame-part 3 of the arm-rest may be mounted on a rotatable post 14 or pivotally mounted on a wall. With the frame-part of the arm-rest mounted on the pillar 14 with a disc-shaped bottom part 15 having downwardly directed circular openings adapted to fit a floor-mounted disc 16 provided with screw heads or the like which fit into the openings, the frame part carrying the arm-rest part can be rotated stepwise to adjust the position of the arm-rest.

We claim:

1. An adjustable arm-rest which includes an arm-rest part and a frame-part, with one end of the arm-rest part inserted through a slot (2) in the frame part and there pivotally connected by a pin to surrounding elements, wherein said one end includes a pressure surface for action against an inner surface of the frame part, characterized in that the surrounding elements have the form of slide blocks (5) provided with spring means (9) and adapted to fix the arm-rest part (1) in position when no load acts on said arm-rest part; and in that said pressure surf ace (6) on said one end of the arm-rest part is adapted to fix the arm-rest part (1) in a lowered position when the arm-rest part (1) is subjected to load.

2. An adjustable arm-rest according to claim 1, characterized in that each slide block (5) is provided with an opening (8) which faces an inner surface of the frame-part; and in that said opening (8) has fitted therein said spring means (9) which functions to press an outer surface (10) of said slide block (5) against the inner surface of said frame-part.

3. An adjustment arm-rest according to claim 2, characterized in that the frame part (3) is pivotally and adjustably mounted on a wall structure.

4. An adjustable arm-rest according to claim 3, characterized in that there is mounted in slot (2) a stop means which includes a plate (11) and a runner provided with screw means (12).

5. An adjustable arm-rest according to claim 4, characterized in that the end (1) of said arm-rest part is provided with an opening (13) whose size corresponds to the width of the plate (11).

6. An adjustable arm-rest according to claim 2, characterized in that the frame part (3) is pivotally and adjustably mounted on a post (14).

7. An adjustable arm-rest according to claim 6, characterized in that the post (14) rests on a floor plate (16) having raised parts which are intended to fit into corresponding recesses on a post-mounted plate (15).

8. An adjustable arm-rest according to claim 7, characterized in that there is mounted in the slot (2) a stop means which includes a plate (11) and a runner provided with screw means (12).

9. An adjustable arm-rest according to claim 1, characterized in that each slide block (5) has an upper part which includes a recess (17) which faces towards an inner surface of the frame part and which accommodates a downwardly suspended reinforcement plate (7).

10. An adjustment arm-rest according to claim 9, characterized in that the frame part (3) is pivotally and adjustably mounted on a wall structure.

11. An adjustable arm-rest according to claim 9, characterized in that the frame part (3) is pivotally and adjustably mounted on a post (14).

12. An adjustable arm-rest according to claim 11, characterized in that the post (14) rests on a floor plate (16) having raised parts which are intended to fit into corresponding recesses on a post-mounted plate (15).

13. An adjustable arm-rest according to claim 12, characterized in that there is mounted in the slot (2) a stop means which includes a plate (11) and a runner provided with screw means (12).

14. An adjustable arm-rest according to claim 13, characterized in that the end (1) of said arm-rest part is provided with an opening (13) whose size corresponds to the width of the plate (11).

15. An adjustment arm-rest according to claim 1, characterized in that the frame part (3) is pivotally and adjustably mounted on a wall structure.

16. An adjustable arm-rest according to claim 15, characterized in that there is mounted in the slot (2) a stop means which includes a plate (11) and a runner provided with screw means (12).

17. An adjustable arm-rest according to claim 16, characterized in that the end (1) of said arm-rest part is provided with an opening (13) whose size corresponds to the width of the plate (11).

18. An adjustable arm-rest according to claim 9, characterized in that the frame part (3) is pivotally and adjustably mounted on a post (14).

19. An adjustable arm-rest according to claim 18, characterized in that the post (14) rests on a floor plate (16) having raised parts which are intended to fit into corresponding recesses on a post-mounted plate (15).

20. An adjustable arm-rest according to claim 19, characterized in that there is mounted in the slot (2) a stop means which includes a plate (11) and a runner provided with screw means (12).

* * * * *